United States Patent [19]

Streit

[11] 4,019,760

[45] Apr. 26, 1977

[54] DEVICE FOR CONNECTING CONDUIT TO A MANHOLE OR THE LIKE

[75] Inventor: Kenneth F. Streit, Mount Prospect, Ill.

[73] Assignee: Phone-Ducs, Inc., West Chicago, Ill.

[22] Filed: Jan. 27, 1975

[21] Appl. No.: 544,379

[52] U.S. Cl. ..... 285/3; 285/158; 285/137 R; 285/423

[51] Int. Cl.[2] ..... E04C 1/39

[58] Field of Search ..... 285/158, 137 R, 230, 285/236, DIG. 16, 423, 3, 330; 52/20, 21; 137/363

[56] References Cited

UNITED STATES PATENTS

| | | | |
|---|---|---|---|
| 2,776,151 | 1/1957 | Harkenrider | 285/423 X |
| 3,543,457 | 12/1970 | Budlong | 285/158 |
| 3,731,448 | 5/1973 | Leo | 52/20 X |
| 3,759,280 | 9/1973 | Swanson | 285/158 X |
| 3,764,151 | 10/1973 | Elder | 285/137 R X |
| 3,792,878 | 2/1974 | Freeman | 285/137 R |

FOREIGN PATENTS OR APPLICATIONS

| | | | |
|---|---|---|---|
| 1,115,104 | 12/1955 | France | 285/423 |

*Primary Examiner*—Andrew V. Kundrat

[57] ABSTRACT

A device is disclosed which is suitable for connecting a multiple bore conduit, buried in the ground, to a manhole having a vertical wall. An adapter is embedded in the manhole wall and has outwardly directed ribs to prevent movement of the adapter perpendicularly to the manhole wall. The conduit has a rib, and a coupling sleeve is positioned about the rib and is juxtaposed to the outside surface of the conduit along an end segment of the conduit, with a gasket seal such as an O-ring being disposed between the coupling sleeve and conduit to create a seal therebetween. An adhesive is applied to an end segment of the outer surface of the coupling sleeve, and the conduit and coupling sleeve are inserted into an end portion of the adapter. The adhesive causes the coupling sleeve to be bonded to the adapter, with a seal being created therebetween, whereby the conduit is mechanically attached to the coupling sleeve which is secured to the adapter, and a seal is created between the conduit and adapter. Stop means are provided on the adapter to limit the insertion of the conduit and coupling sleeve into the adapter.

18 Claims, 5 Drawing Figures

DEVICE FOR CONNECTING CONDUIT TO A MANHOLE OR THE LIKE

BACKGROUND OF THE INVENTION

This invention relates to devices for connecting multiple bore conduit sections that are buried in the ground to a manhole.

With the increasing use of transmission lines, such as telephone and telegraph cables, computer data lines and cable television, as well as public protestations against above ground transmission towers, underground burial of cables has become the expedient used to provide a path for such cables. The use of buried conduit sections to provide cable passages not only overcomes public dissatisfaction with above ground installations, but also provides an economical way of expanding capacity without a great increase in capital costs required by erecting new transmission towers or gaining access to new rights of way, because conduit sections with excess capacity can be initially installed. Cable conduits that have been proposed in the past include those disclosed in commonly assigned U.S. Pat. Nos. 3,545,493 and 3,792,878, and in my copending, commonly assigned U.S. Patent Application Ser. No. 403,248 filed Oct. 3, 1973.

Underground conduits are frequently connected to manholes which provide predetermined points for convenient access to the cables in the conduits. In the past, portions of manhole walls have often had to be knocked out to provide an opening for a conduit section, and it has not always been possible to create a water-tight seal between the conduit and the manhole wall.

One recurring problem is connecting conduits to manhole walls in the difficulty of connecting polyolefinic materials, such as conduit to a concrete manhole wall, due to the dissimilarity of the materials. Additionally, due to the confined nature of the working area, it is difficult to make a connection by using extraneous fasteners and connecting devices.

There is often loose fill adjacent to the manhole wall, which results in the ground settling beneath the conduit. Void areas can thus occur beneath the conduit, resulting in a substantial decrease in ground bearing support of the conduit. With increasing depths of burial and increasing conduit widths, greater pressure is presented on the conduit, particularly in areas adjacent to manholes. It is therefore important to have a high-strength connection between the conduit and the manhole wall.

SUMMARY OF THE INVENTION

According to the present invention, a device is disclosed for connecting a multiple bore conduit which is buried in the ground to a manhole having a vertical wall. An adapter having an inside wall is embedded in the manhole wall when it is cast, thereby obviating the need for knocking out a portion of the manhole wall and enabling the conduit to be connected to a material other than concrete. The adapter has at least one outwardly directed rib to prevent movement of the adapter perpendicularly to the manhole wall.

A portion of a conduit section is receivable in the adapter, and the adapter has an inward directed flange disposed along a midportion thereof to serve as a stop means to limit the insertion of the conduit into the adapter and to position the conduit within the adapter.

The conduit has a rib, and an end segment of the conduit disposed outwardly of the rib is receivable in the manhole wall. A coupling sleeve is positioned about the rib and is juxtaposed to the outside surface of the conduit along the conduit end segment. The coupling sleeve has at least one discontinuity to enable the coupling sleeve to be positioned about the conduit section, and preferably comprises two generally U-shaped mating portions, the ends of which are gasketed or sealed together or to the conduit. The coupling sleeve is thereby mechanically attached to the conduit, with the rib preventing relative longitudinal displacement between the conduit and the coupling sleeve. A gasket seal such as an O-ring is preferably disposed between the coupling sleeve and the conduit to create a seal therebetween.

When the coupling sleeve is juxtaposed to the conduit, the inside transverse dimension along an end portion of the adapter directed toward the conduit is greater than the outside transverse dimension along the end segment of the coupling sleeve which is juxtaposed to the end segment of the conduit, so that the coupling sleeve and conduit can be inserted into the adapter.

The conduit sections are preferably molded from a high impact plastic such as polyolefinic materials like linear polyethylene, and the coupling sleeve and adapter are formed of a plastic such as polyvinyl chloride, acrylonitride-butadienestyrene, or other material which is suitable for bonding the coupling sleeve to the adapter.

The adhesive for bonding the coupling sleeve to the adapter is initially a liquid and is applied to the outer surface of the end segment of the coupling sleeve. The conduit and coupling sleeve are inserted into the adapter, and adhesive hardens to bond the coupling sleeve to the end portion of the inner wall of the adapter, and a seal is created therebetween. The conduit is thereby mechanically attached to the coupling sleeve, and the outside surface of the coupling sleeve is bonded to the adapter which is embedded in the manhole wall. The conduit is thus connected to the manhole without requiring the use of extraneous fasteners, and a water-tight seal is created between the conduit and the adapter, and between the adapter and manhole wall. Since known adhesives for joining polyolefins to polyolefins are expensive and/or do not provide a connection for adequate strength, the present invention obviates this problem by mechanically attaching the conduit to a coupling sleeve which is bonded to an adapter formed of a compatible material as the coupling sleeve. The adapter and coupling sleeve can readily be secured together by an inexpensive material to form a strong joint therebetween.

DETAILED DESCRIPTION OF THE PREFERRED EMBODIMENTS

Figures 1, 2, 4, 5:
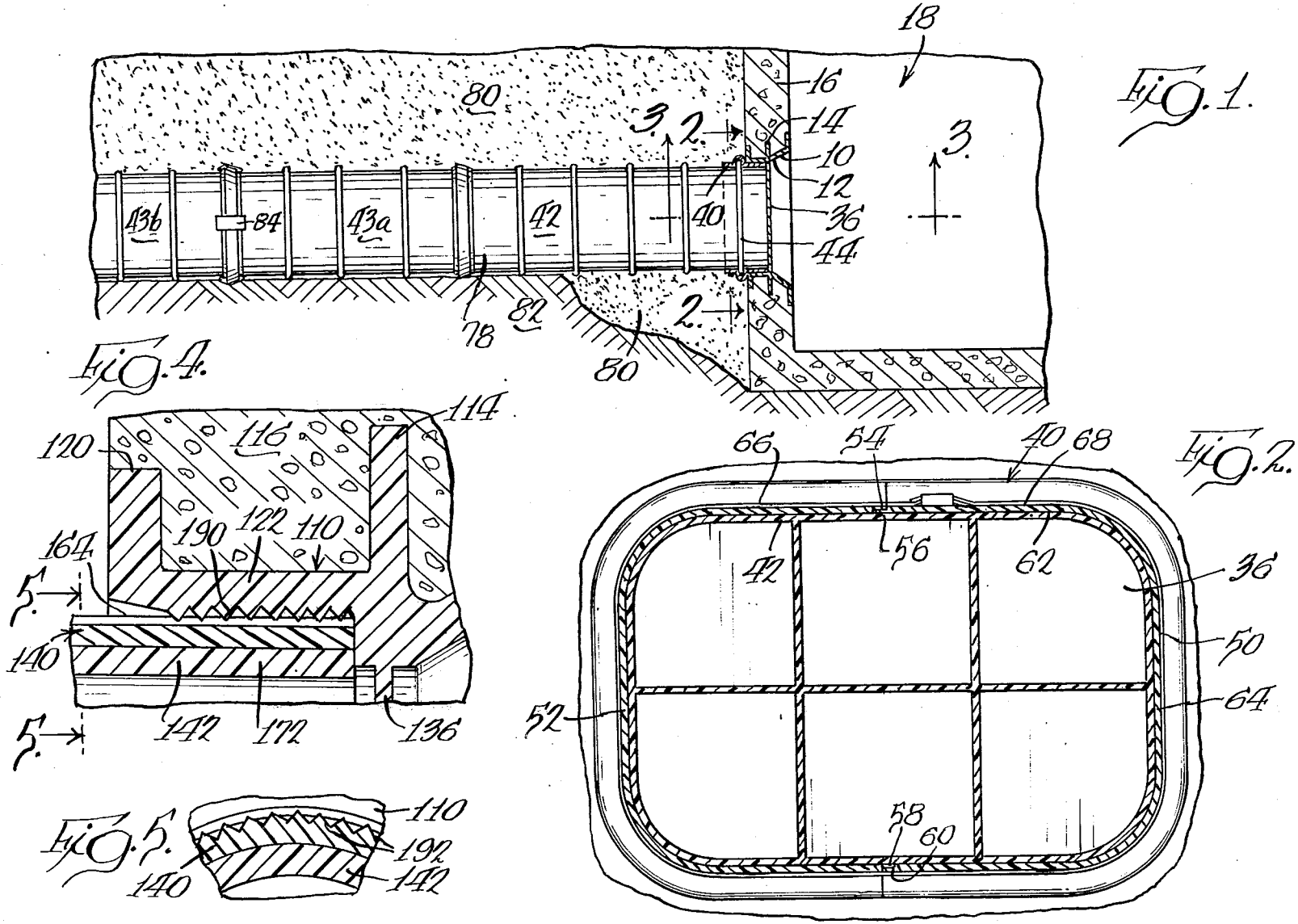
FIG. 1 is a front view, partly in cross-section, of the device of the present invention connecting a conduit section to a manhole.
FIG. 2 is an enlarged cross-sectional view taken along plane 2—2 in FIG. 1.
FIG. 4 is a fragmentary cross-sectional view similar to FIG. 3 and illustrating an alternate embodiment of the invention.
FIG. 5 is a fragmentary cross-sectional view taken along plane 5—5 in FIG. 4.

While this invention is susceptible of embodiment in many different forms, there is shown in the drawings and will herein be described in detail a preferred embodiment in accordance with the present invention, and with the understanding that the present disclosure is to be considered as an exemplification of the principles of the invention and is not intended to limit the invention to the specific embodiments illustrated and described.

Referring first to FIG. 1, the present invention provides a novel means for connecting the end of one of a plurality of interconnected conduit sections to the wall 16 of a manhole 18. The connecting means includes an adapter 10 embedded in the manhole wall and a coupling sleeve 40 secured to the end of a conduit section 42.

Figure 3:
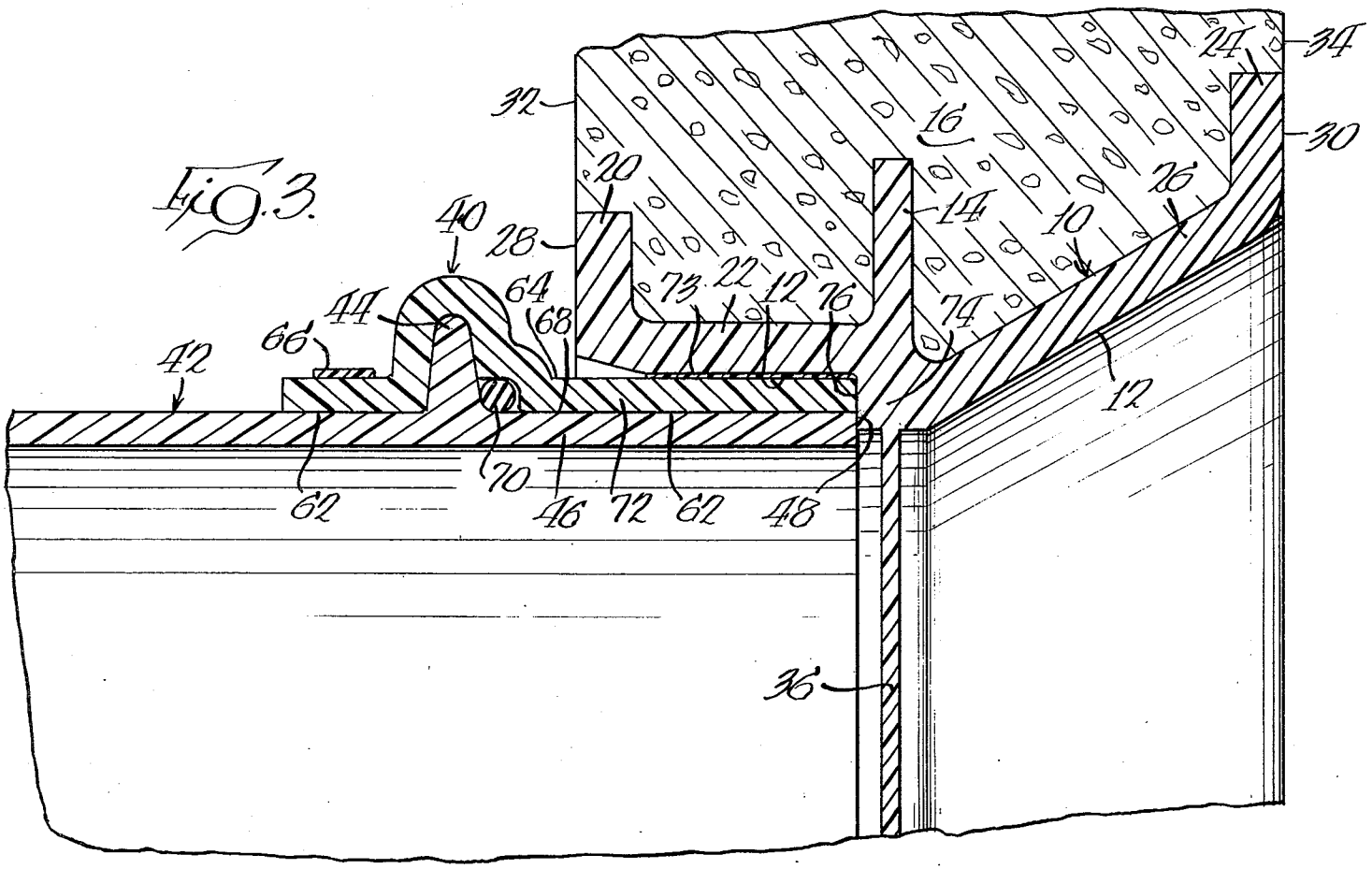
FIG. 3 is an enlarged fragmentary cross-sectional view taken along plane 3—3 in FIG. 1.

Referring to FIGS. 1 and 3, adapter 10 has inner wall 12 and at least one centrally disposed outwardly directed rib 14 integral with the adapter and embedded in the vertical wall 16 of a manhole 18. Adapter 10 also has a rib 20 at the distal end of first end portion 22, and rib 24 at the distal end of opposite end portion 26, with ribs 20 and 24 being outwardly directed and preferably having outer sidewalls 28 and 30 aligned with outer sidewall 32 and inner sidewall 34 of manhole wall 16. Ribs 14, 20 and 24 prevent movement of adapter 10 perpendicularly to manhole wall 16.

Adapter 10 can be embedded in the form for a manhole wall to create an opening in the manhole wall when the wall is formed, thereby obviating the need for knocking out a portion of a pre-existing manhole wall to provide an opening therein, and insuring that a water-tight seal is created between adapter 10 and the manhole wall 16. The adapter may be provided with a transverse wall 36 extending between the inner walls 12 of opposite end portion 26 of adapter 10 to seal manhole 18 from the first end portion 22 of adapter 10. Transverse wall 36 may be integral with adapter 10 and rigid to provide additional support for maintaining the shape of the adapter embedded in manhole wall 16. When desired, transverse wall 36 may be cut and removed from adapter 10.

Adapter 10 is used in conjunction with a coupling sleeve 40 to connect a conduit section 42 to manhole 18. As illustrated in FIG. 1, a plurality of conduit sections 42, 43*a* and 43*b* are positioned in a trench which is excavated in the earth's surface to a depth desirable for burial of cables, such as telephone or telegraph cables. Each conduit section is substantially the same in configuration as the other conduit sections, and is made from a high impact plastic, such as linear polyethylene which may be conveniently formed by injection molding. Conduit sections 42 suitable for use with the present invention include those described in my copending commonly assigned U.S. Patent Application Ser. No. 403,248 filed Oct. 3, 1973, and commonly assigned U.S. Pat. Nos. 3,545,493 and 3,792,878.

Since the conduit sections which are illustrated in FIG. 1 and disclosed in the above-mentioned patent and application have securement means at both ends of each section for securing together adjacent conduit sections, conduit section 42 is severed between rib 44 and an adjacent rib (not shown), with the end segment 46 of conduit between distal end 48 of the severed conduit section 42 and rib 44 being inserted in adapter 10 when connecting conduit 42 to manhole wall 16. Thus, rib 44 is adjacent to end segment 46 and serves as a stop means to limit the insertion of conduit end segment 46 and coupling sleeve 40 into adapter 10.

Conduit section 42 is mechanically attached to coupling sleeve 40 which has at least one longitudinally extending discontinuity to enable the coupling sleeve to be positioned about conduit section 42. As shown in FIG. 2, coupling sleeve 40 preferably comprises two generally U-shaped mating portions 50 and 52 having ends 54 and 56 overlapping on one side of conduit 42 and ends 58 and 60 overlapping on the opposite side of conduit 42. Coupling sleeve 40 has an inside surface 62 and an outside surface 64 and is positioned about conduit 42 so that a portion of inside surface 62 of coupling sleeve 40 is juxtaposed to outer surface 68 of end segment 46 of conduit section 40.

A strap 66 of plastic, metal or other suitable material may be wrapped about the outside surface 64 of coupling sleeve 40 to retain the coupling sleeve in position. The overlapping ends 54 and 56; 58 and 60 of coupling sleeve portions 50 and 52 may be secured together by adhesive bonding or welding.

Rib 44 on conduit section 42 is integral therewith and extends at least partially around the conduit. To prevent longitudinal movement of the coupling sleeve relative to conduit section 42, coupling sleeve 40 has a configuration conforming to rib 44 and inside surface 62 of coupling sleeve 40 is juxtaposed to outside surface 68 of conduit 42 on both sides of rib 44. Thus, in addition to serving as a stop means when conduit 42 is inserted in adapter 10, rib 44 prevents longitudinal movement between coupling sleeve 40 and conduit 42 and enables a mechanical attachment therebetween.

In the preferred embodiment, a gasket seal such as an O-ring or other gasket 70 (FIG. 3) is disposed between coupling sleeve 40 and conduit 42 to create a sealing effect therebetween. Rib 44 preferably extends entirely around conduit 42, and gasket 70 is disposed adjacent to the base of rib 44 on end segment 46 of conduit 42 and the coupling sleeve 40 has a configuration conforming to both the rib 44 and gasket 70, with the gasket being continuously in communication with both the coupling sleeve and conduit. Alternatively, two gaskets can be positioned between the coupling sleeve and conduit, with one gasket being positioned on each side of rib 44.

Referring to FIGS. 1 and 3, first end portion 22 of adapter 10 has an inside transverse dimension greater than the outside transverse dimension along end segment 72 of coupling sleeve 40 to enable end segment 46 of conduit 42 and end segment 72 of coupling sleeve 40 to be inserted into adapter 10.

As discussed hereinabove, rib 44 on conduit 42 and the correspondingly shaped portion of coupling sleeve 40 serve as a stop means to limit the extent to which conduit 42 and coupling sleeve 40 are inserted into adapter 10. As best illustrated in FIG. 3, the preferred embodiment of adapter 10 includes an inwardly directed flange 74 disposed inwardly from first end portion 22. Flange 74 has an outwardly directed sidewall 76 facing conduit 42 and which acts as a stop means to limit the insertion of condiut 42 and coupling sleeve 40 within adapter 10. Conduit 42 is positioned within adapter 10 when the distal end 48 of the conduit abuts sidewall 76 of flange 74.

The prefered means of connecting the conduit to the manhole wall includes a solvent bond, wherein the solvent material creates a chemical bond between the material to which it is applied, and the adapter which is embedded in the manhole wall. The solvent evaporates and the adjacent pieces are chemically bonded together.

Since the conduit is formed of polyolefinic materials, such as polyethylene, which is not dissolvable by a solvent to create a chemical bond and cannot be conveniently bonded in the field directly to the adapter or manhole wall, the present invention utilizes a coupling sleeve which is mechanically attached to the conduit. Both the coupling sleeve and the adapter are formed of polyvinyl chloride, acrylonitride-butadiene-styrene or other compatible plastic materials which will be attacked by the solvent to create a strong chemical bond therebetween. Preferably, the coupling sleeve and adapter are formed of the same material. Thus, lightweight conduit sections preferably molded from a high impact plastic such as polyolefins are mechanically attached to the inside surface 62 of coupling sleeve 40, with gasket 70 creating a sealing effect therebetween, and the outside surface 64 of coupling sleeve 40 is bonded to adapter 10 with a seal being created between coupling sleeve 40 and adapter 10. A water-tight seal is thereby formed between conduit 42 and adapter 10 and the conduit is connected to the manhole 18, and a commonly used and accepted method of bonding is used to provide a strong joint between the coupling sleeve and the adapter.

Referring now to FIG, 3, second end portion 26 of adapter 10 is outwardly flared to facilitate access to conduit 42. Inner wall 12 along opposite end portion 26 preferably forms an angle of about 30° relative to inner wall 12 along first end portion 22 of adapter 10.

As shown in FIG. 1, end 78 of conduit section 42 is secured to one end of an adjacent conduit section 43*a*, and the opposite end of conduit section 43*a* is secured to an adjacent conduit section 43*b*. Since there is commonly loose fill 80 adjacent to manhole wall 18, and loose fill 80 provides poor support for conduit section 42, conduit section 42 may be welded to conduit section 43*a* to provide additional support for conduit section 42. Further away from manhole wall 18, earth 82 provides adequate support for the conduit, so conduit sections 43*a* and 43*b*, and subsequent conduit sections further disposed from manhole wall 18 may be secured together with spring clips 84 as disclosed in the abovementioned patents and application.

To connect conduit section 42 to manhole adapter 10 which is embedded in manhole wall 18, a gasket 70 is positioned adjacent to rib 44, and coupling sleeve is placed about conduit 42, with a portion of inside surface 62 of coupling sleeve 40 being juxtaposed to outer surface 68 of end segment 46 of conduit 42. Strap 66 is secured about the outside surface 64 of coupling sleeve 40 to retain the coupling sleeve in position. The opposite ends of coupling sleeve 40 are secured together, or to conduit 42, by adhesive or welding. After assembly of sleeve 40, conduit 42 is cut so that an even end is provided for insertion into adapter 10. Outside surface 64 along end segment 72 of coupling sleeve 40 is brushed with the solvent adhesive, and the coupling sleeve 40 and conduit 42 are inserted into the adapter 10 until distal end 48 of conduit 42 abuts sidewall 76 of flange 74 on adapter 10. The solvent evaporates and leaves the coupling sleeve 40 chemically bonded to adapter 10, and the conduit is thereby connected to the manhole, with a water-tight seal being created between conduit 42 and adapter 10. Transverse wall 36 in the adapter 10 can be removed to provide access to the conduit 42 from the manhole.

An alternative embodiment is illustrated in FIGS. 4 and 5, and similar reference numerals in the one hundred series are utilized to designate elements which correspond to like elements in the previously described embodiment. In the embodiment of FIGS. 4 and 5, the first end 122 of adapter 10 is provided with serrations 190 extending continuously about the inside wall of the adapter along first end 122, and coupling sleeve 140 is provided with serrations 192 extending longitudinally along outside surface 164 of sleeve 140. The coupling sleeve and adapter are solvent bonded together by adhesive (not shown). Serrations 190 and 192 are perpendicular in direction to provide an interference fit between the coupling sleeve and adapter. The serrations displace adhesive material and increase the area of bond. The use of serrations obviates tolerance problems that frequently occur when trying to insert the coupling sleeve and conduit section into the adapter.

I claim:

1. A device suitable for connecting a conduit section having a longitudinal axis to a manhole having a vertical wall, comprising:

an adapter having inner walls and at least one outwardly disposed rib, said adapter being embedded in the wall of said manhole with each said rib preventing movement of said adapter perpendicularly to said manhole wall, said adapter having a first end portion directed toward said conduit, said conduit having a first end portion with an outer surface, a coupling sleeve juxtaposed to said outer surface of said conduit along said first end portion of said conduit, mens for claimping said coupling sleeve to said conduit, cooperating rib and recess means on said sleeve and said conduit means for preventing longitudinal movement of said coupling sleeve relative to said conduit.

said first emnd portion of said adapter having an inside transverse dimension which is greater than the outside transverse dimension of said coupling sleeve along said first end portion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto to connect said conduit to said manhole.

2. A device as defined in claim 1 having stop means to limit the insertion of said conduit first end portion and said coupling sleeve into said first end of said adapter.

3. A device as defined in claim 2 wherein said stop means comprises an inwardly directed flange on said adapter disposed inwardly from said first end portion of said adapter, whereby said conduit abuts said flange to position the conduit within the adapter.

4. A device as defined in claim 1 wherein said coupling sleeve and said adapter are formed of a lightweight plastic material, and said coupling sleeve has an external surface which is coated with an adhesive material for securing said coupling sleeve to said inner wall of said adapter along said first end portion of said adapter.

5. A device as defined in claim 1 wherein said adapter has a transverse wall integral therewith and extending between said inner walls of said adapter, said transverse wall sealing said manhole from said conduit until it is desired to remove said transverse wall.

6. A device as defined in claim 5 wherein said transverse wall is reigid and provides support for maintaining the shape of said adapter in the wall of said manhole.

7. A device as defined in claim 1 wherein said adapter has a second end portion which is outwardly flared to facilitate access to said conduit.

8. A device as defined in claim 7 wherein said inner wall of said second end portion of said adapter forms an angle of about 30° relative to said inner wall of said first end portion of said adapter.

9. A device suitable for connecting a conduit section having a longitudinal axis to a manhole having a vertical wall, comprising:

an adapter having inner walls and at least one outwardly disposed rib, said adapter being embedded in the wall of said manhole with each said rib preventing movement of said adapter perpendicularly to said manhole wall, said adapter having a first end portion directed toward said conduit, said conduit having a first end portion with an outer surface, a coupling sleeve juxtaposed to said outer surface of said conduit along said first end portion of said conduit, a gasket being disposed between said coupling sleeve and said conduit to create a sealing effect therebetween, attachment means for attaching said coupling sleeve to said conduit, means for preventing longitudinal movement of said coupling sleeve relative to said conduit, said adapter having an inside transverse dimension along said first end portion of said adapter which is greater than the outside transverse dimension of said coupling sleeve along said first end portion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto to connect said conduit to said manhole and thereby creating a seal between said conduit and said adapter.

10. A device suitable for connecting a conduit section having a longitudinal axis to a manhole having a vertical wall, comprising:

an adapter having inner walls and at least one outwardly disposed rib, said adapter being embedded in the wall of said manhole with each said rib preventing movement of said adapter perpendicularly to said manhole wall, said adapter having a first end portion directed toward said conduit, said conduit having a first end portion with an outer surface, a coupling sleeve juxtaposed to said outer surface of said conduit along said first end portion of said conduit, attachement means for attaching said coupling sleeve to said conduit, means for preventing longitudinal movement of said coupling sleeve relative to said conduit comprising a rib integral with said conduit and extending at least partially around said conduit and positioned adjacent to said first end portion of said conduit, said coupling sleeve having a configuration conforming to and extending along both sides of said rib, whereby said rib prevents longitudinal movement between said coupling sleeve and said conduit, said adapter having an inside transverse dimension along said first end portion of said adapter which is greater than the outside transverse dimension of said coupling sleeve along said first end portion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto to connect said conduit to said manhole.

11. A device as defined in claim 10 wherein said conduit rib is continuous and extends entirely around said conduit, said conduit rib has a base portion, and a gasket is disposed adjacent to said base of said conduit rib and between said conduit and said coupling sleeve to create a sealing effect therebetween, and thereby creating a seal between said conduit and said adapter, said coupling sleeve having a configuration which also conforms to said gasket.

12. A device suitable for connecting a conduit section having a longitudinal axis to a manhole having a vertical wall, comprising:

an adapter having inner walls and at least one outwardly disposed rib, said adapter being embedded in the wall of said manhole with each said rib preventing movement of said adapter perpendicularly to said manhole wall, said adapter having a first end portion directed toward said conduit, said conduit having a first end portion with an outer surface, a coupling sleeve juxtaposed to said outer surface of said conduit along said first end portion of said conduit, said coupling sleeve having at least one discontinuity extending longitudinally along said coupling sleeve to enable said coupling to be positioned about said conduit, and means for securing said coupling sleeve together on each side of each discontinuity, attachments means for attaching said coupling sleeve to said conduit, means for preventing longitudinal movement of said coupling sleeve relative to said conduit, said adapter having an inside transverse dimension along said first end portion of said adapter which is greater than the outside transverse dimension of said coupling sleeve along said first end portion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto to connect said conduit to said manhole.

13. A device as defined in claim 12 wherein said coupling sleeve comprises two generally U-shaped mating portions having first and second overlapping ends which are secured together.

14. A device suitable for connecting a conduit section having a longitudinal axis to a manhole having a vertical wall, comprising:

an adapter having inner walls and at least one outwardly disposed rib, said adapter being embedded in the wall of said manhole with each said rib preventing movement of said adapter perpendicularly to said manhole wall, said adapter having a first end portion directed toward said conduit, said conduit having a first end portion with an outer surface, a coupling sleeve juxtaposed to said outer surface of said conduit along said first end portion of said conduit, a strap being wrapped around said coupling sleeve to retain the coupling sleeve in position, attachment means for attaching said coupling sleeve to said conduit, means for preventing longitudinal movement of said coupling sleeve relative to said conduit, said adapter having an inside transverse dimension along said first end portion of said adapter which is greater than the outside transverse dimension of said coupling sleeve along said first end portion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto to connect said conduit to said manhole.

15. A device suitable for connecting a conduit section having a longitudinal axis to a manhole having a vertical wall, comprising:

an adapter having inner walls and at least one outwardly disposed rib, said adapter being embedded in the wall of said manhole with each said rib preventing movement of said adapter perpendicularly to said manhole wall, said adapter having a first end portion directed toward said conduit, said adapter being provided with a plurality of serrations extending continuously about said inner wall along said first portion of said adapter, said conduit having a first end portion with an outer surface, a coupling sleeve juxtaposed to said outer surface of said conduit along said first end portion of said conduit, attachment means for attaching said coupling sleeve to said conduit, means for preventing longitudinal movement of said coupling sleeve relative to said conduit, said adapter having an inside transverse dimension along said first end portion of said adapter which is greater than the outside transverse dimension of said coupling sleeve along said first end portion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto to connect said conduit to said manhole with an interference fit being created between said adapter and said coupling sleeve.

16. A device suitable for connecting a conduit section having a longitudinal axis to a manhole having a vertical wall, comprising:

an adapter having inner walls and at least one outwardly disposed rib, said adapter being embedded in the wall of said manhole with each said rib preventing movement of said adapter perpendicularly to said manhole wll, said adapter having a first end portion directed toward said conduit.

said conduit having a first end portion with an outer surface, a coupling sleeve juxtaposed to said outer surface of said conduit along said first end portion of said conduit, said coupling sleeve having an outside surface which is provided with a plurality of serrations, attachment means for attaching said coupling sleeve to said conduit, means for preventing longitudinal movement of said coupling sleeve relative to said conduit, said adapter having an inside transverse dimension along said first end portion of said adapter which is greater than the outside transverse dimension of said coupling sleeve along said first end portion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto to connect said conduit to said manhole with an interference fit being created between said adapter and said coupling sleeve.

17. A device suitable for connecting a conduit section having a longitudinal axis to a manhole having a vertical wall, comprising:

an adapter having inner walls and at least one outwardly disposed rib, said adapter being embedded in he wall of said manhole with each said rib preventing movement of said adapter perpendicularly to said manhole wall, said adapter having a first end portion directed toward said conduit, said adapter being provided with a plurality of serratons extending continuously about said inside wall along said first portion of said adapter, said conduit having a first end portion with an outer surface, a coupling sleeve juxtaposed to said outer surface of said conduit along said first end portion of said conduit, said coupling sleeve having an outside surface which is provided with a plurality of serrations, said serrations on said adapter being perpendicular to said serrations on said coupling sleeve, attachment means for attaching said coupling sleeve to said conduit, means for preventing longitudinal movement of said coupling sleeve relative to said conduit, said adapter having an inside transverse dimension along said first end portion of said adapter which is greater than the outside transverse dimension of said coupling sleeve along said first end porion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto connect said conduit to said manhole with an interference fit created between said adapter and said coupling sleeve.

18. A device suitable for connecting a conduit section having a longitudinal axis to a manhole having a vertical wall, comprising:

an adapter having inner walls and at least one outwardly, disposed rib, said adapter being embedded in the wall of said manhole with each said rib preventing movement of said adapter perpendicularly to said manhole wall, said adapter having a first end portion directed toward said conduit, said conduit having a first end portion with an outer surface, a rib integral with said conduit being positioned adjacent to said first end portion of said conduit and extending at least partially around said conduit, a coupling sleeve juxtaposed to said outer surface of said conduit along said first end portion of said conduit, attachment means for attaching said coupling sleeve to said conduit, means for preventing longitudinal movement of said coupling sleeve relative to said conduit, said adapter having an inside transverse dimension along said first end portion of said adapter which is greater than the outside transverse dimension of said coupling sleeve along said first end portion of said conduit when said coupling sleeve is juxtaposed to said conduit, sealing means for securing said coupling sleeve to said adapter along said first end portion of said adapter, said first end portion of said conduit and said coupling sleeve being insertable into said first end portion of said adapter for securement thereto to connect said conduit to said manhole, said rib comprising a stop means to limit the insertion of said conduit first end portion and said coupling sleeve into said first end of said adapter.

* * * * *

UNITED STATES PATENT AND TRADEMARK OFFICE

CERTIFICATE OF CORRECTION

PATENT NO. : 4,019,760

DATED : April 26, 1977

INVENTOR(S) : Kenneth F. Streit

It is certified that error appears in the above-identified patent and that said Letters Patent are hereby corrected as shown below:

Column 6, line 37, "mens" should be --means--.

Column 6, line 43, "emnd" should be --end--.

Column 7, line 10, "reigrd" should be --rigid--.

Column 7, line 11, after the word "adapter" insert --embedded--.

Column 10, line 17, "wll" should be --wall--.

Column 10, line 50, "he" should be --the--.

Column 11, line 12, after the word "thereto" insert --to--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*